United States Patent [19]

MacKay

[11] Patent Number: 4,624,086

[45] Date of Patent: Nov. 25, 1986

[54] ADJUSTABLE SELF-LEVELING SLEEVE INSERT FOR CONCRETE PASSAGES

[76] Inventor: Robert K. MacKay, 44 Irving Dr., South Walpole, Mass. 02071

[21] Appl. No.: 678,254

[22] Filed: Dec. 5, 1984

[51] Int. Cl.[4] ..... E04B 5/48

[52] U.S. Cl. ..... 52/220; 249/219.1; 248/56

[58] Field of Search ..... 52/220, 380, 382, 577, 52/699, 700, 701; 249/18, 219 R

[56] References Cited

U.S. PATENT DOCUMENTS

| | | | |
|---|---|---|---|
| 4,170,853 | 10/1979 | Kohaut | 52/699 X |
| 4,192,481 | 3/1980 | Durbin | 249/219 X |
| 4,198,798 | 4/1980 | Haydock | 52/699 |

*Primary Examiner*—William F. Pate, III
*Assistant Examiner*—Creighton Smith
*Attorney, Agent, or Firm*—Donald W. Meeker

[57] ABSTRACT

A cast iron pipe sleeve is provided at each end with a tight-fitting metal disk. A threaded steel rod is screwed into a nut welded in the center of the inside face of a solid disk. The disk rests against the outer edge of the sleeve and the rod extends through the interior of the sleeve and out through a hole in the center of the opposite disc and further through a hole in one of the form walls. One or more wire cables or chains secure the outer disc to the inner edge of the pipe sleeve. Alternately, the solid disc may be centrally located within the pipe sleeve and cables secured by hooks between the solid disc and the outer edge of the pipe sleeve. A long bar or channel provided with a center hole is placed over the end of the rod and across two external studs on the form wall. As a nut is tightened onto the end of the rod against the channel, the sleeve is drawn securely and squarely against the form wall. After the other form wall is secured in place tightly against the second end of the sleeve, the concrete is poured and cured, the exterior nut is removed, the form walls are removed, and the discs and rod are removed to be reused. The sleeve remains cast in the concrete as a cylindrical passage through the thickness of the concrete for pipes. One alternate embodiment provides an interior disc bolted within the sleeve. Another embodiment provides a sleeve extending completely through the form with a bar and spacer bolted to the form ribs.

20 Claims, 8 Drawing Figures

ADJUSTABLE SELF-LEVELING SLEEVE INSERT FOR CONCRETE PASSAGES

BACKGROUND OF THE INVENTION

1. Technical Field

Apparatus for use with panels in a molded structure such as forms for poured concrete construction, having means extending through or abutting against at least one panel to form an opening extending through the major face of the molded structure and related retaining apparatus.

2. Background Art

In reinforced concrete structures, providing a passageway through a wall for pipes or other utilities has consumed a considerable amount of time requiring five or six men approximately three days to install a passageway sleeve properly.

Prior art devices required great effort to climb in among the reinforcement bars between concrete forms to install a pipe sleeve.

In the past alignment of pipe sleeves was a major problem in fitting the sleeve around the reinforcing bars and assuring a level placement fitting squarely with the form walls.

Considerable wire and other material has been required to secure a pipe sleeve to the reinforcing bars, and the material was left in place within the wall after the concrete was poured.

Other sleeves have required considerable tie-in means to the reinforcing bars or attachment to both form walls or both to provide the strength necessary to resist the tremendous load placed upon the sleeve by the heavy poured concrete.

Some prior art sleeves provided uneven interior passages because of soft bendable shells, overlapping tubes, undulating shells, tapered elements of parts remaining attached to the sleeves.

DISCLOSURE OF INVENTION

With the present invention considerable time and labor costs are saved because the sleeve can be properly installed by two workers in twenty minutes.

Because the present invention may be installed to a single form wall before the reinforcement bars and opposite form wall are in place, installation requires little effort having easy access to the work area.

Self-alignment is built into the present invention with a flat sleeve end and a broad support outside the form to pull the sleeve squarely against the single form wall, thereby assuring an accurate square and level fit automatically.

With the single self-securing form clamping system of the present insert considerable material is saved especially since the entire insert within the sleeve may be removed from the sleeve when the forms are removed and the entire insert reused for other sleeve installations.

Providing a broad support member which spans the ribs on the outside of the form wall creates a substantial moment arm to resist the forces placed upon the sleeve by the weight of the heavy poured concrete and thereby is a secure self-supporting attachment for the sleeve to a single form wall.

With a fully removable insert inside a smooth self-supporting sleeve which passes completely through the wall and remains in place, the present invention provides a completely smooth passageway through the wall and beyond if desired.

Securing the outer components of the invention to the inner components secured to the form wall provides convenience and safety by retaining the pipe sleeve or end disc upon loosening the attaching means.

Providing an internal disc smaller than the pipe sleeve diameter connected to a series of equal-length retainer members hooked over the end of the pipe sleeve and adjustable pipe sleeve insert can be used with a variety of pipe sleeve sizes.

BRIEF DESCRIPTION OF DRAWINGS

These and other details and advantages of my invention will be described in connection with the accompanying drawings, which are furnished only by way of illustration but not in limitation of the invention, and in which drawings.

BEST MODE FOR CARRYING OUT THE INVENTION

Figure 1:
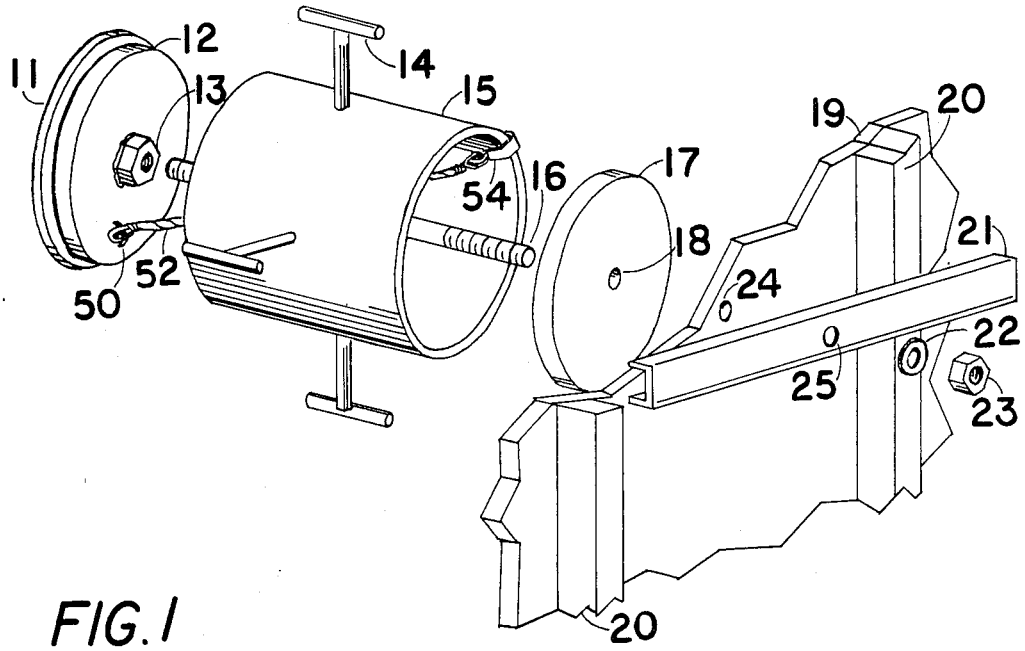
FIG. 1 is a perspective view of the components of the invention aligned for assembly with the form wall shown in broken section.

In FIG. 1 the sleeve 15 is a rigid hollow cylinder preferably made of metal such as a section of cast iron pipe. Attached by welding around the exterior surface of the pipe are standard protruding studs 14 which become surrounded by the concrete when it is poured.

A flat circular disc, also preferably of metal such as sheet steel, forms a solid end cap 11 provided around its perimeter with a 1/16" lip 12 extending beyond the disc to contact the sleeve end so that the disc rests against one end of the sleeve 15 to form a flat covering to enclose the end of the sleeve. Welded to the center of the solid end cap 11 is a nut 13 which receives the threaded interior end of a rigid rod 16 preferable of metal such as steel. The rod forms an elongated protrusion extending from the solid end cap 11 at one end of the sleeve through the center of the sleeve 15 and out the other end. Welded to the interior peripheral surface of the end cap one or more semi-circular loops 50 receive an elongated retaining means 52 such as a wire cable which is secured to the opposite edge of the pipe sleeve by a hook 54 to retain the end cap after release of the rod 16.

Other possible retaining means include link chains or roller chains.

At the other end a second end cap 17 is a rigid circular disc fabricated of any stiff sheet material such as wood or metal. Slightly smaller than the interior diameter of the sleeve, the second end cap 17 fits snugly inside the end of the sleeve with a friction fit. Centrally located in the second end cap 17 a circular cap hole 18 through the cap is just large enough to admit the rod 16 therethrough and hold the rod securely in the center of the sleeve 15.

The form wall 19, which may be provided with support studs 20 spaced across its outer surface, is further provided with a wall hole 24 sufficient diameter to admit the rod 16 therethrough. The wall hole 24 is preferably located centrally between two support studs 20, although it may be located anywhere on the wall as required for pipe location.

A rigid cross-member 21 such as a length of steel channel is provided with a central channel opening 25 just large enough to admit the rod 16.

The entire sleeve apparatus is easily installed by two workers in twenty minutes. After one form wall 19 has been erected, before the reinforcing bars are put into place, a form hole 24 is drilled through the form wall 19 at the point in the wall where the centerline of the pipe or other utility conduit will pass through the wall.

Figure 2:
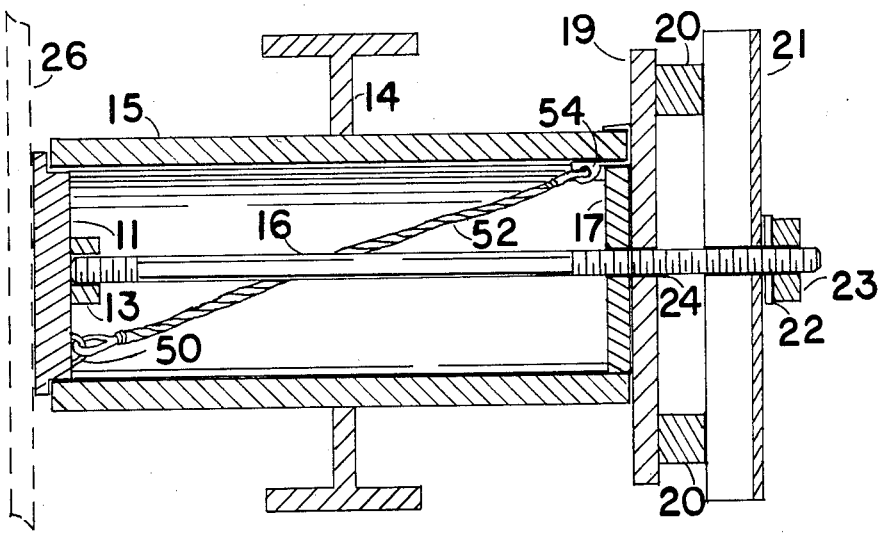
FIG. 2 is a cross-sectional view of the preferred embodiment of the invention taken through the centerline of the sleeve as installed on the form wall.

As seen in FIG. 2, the rod 16 is screwed securely into the nut 13 which is welded to the center of the inner face of the solid end cap 11. After securing the hook 54 over the edge of the pipe sleeve and forcing the second end cap 17 into one end of the sleeve, the rod 16 is then inserted in the opposite end of the sleeve 15 through the inside of the sleeve and out through the cap hole 18 until the solid end cap 11 is secured over the opening to the sleeve with the peripheral flange 12 contacting the end face of the sleeve. Should a form rib 20 or other obstacle be located where the threaded rod 16 must be located, the rod may be offset by bending as shown in dashed lines 16A at the connecting end of the rod.

By lifting the sleeve 15, the end of the rod 16 is then inserted by one workman through the form hole 24 until the flat end of the sleeve contacts the inner surface of the form wall 19. A second workman then slides cross-member 21 over the end of the rod 16 until the cross-member 21 contacts the support studs 20, or the form wall itself if there are no support studs.

The second workman then secures the cross-member 21 very tightly onto the rod and against the sleeve by applying a nut 23 and washer 22 to the end of the rod 16. Tightening a nut 23 draws the sleeve squarely and securely against the inner surface of the form wall 19. Accurate placement and leveling of the sleeve are provided automatically because the holes are aligned and the sleeve surface conforms to the inner wall surface. Resistance of the sleeve to movement by the heavy concrete is provided by the leverage of the long moment arm provided by the cross-member 21 extending over a substantial portion of the outer surface of the form wall beyond the perimeter of the sleeve.

Reinforcing rods may then be installed and the opposing form wall 26 (dashed lines) erected with its inner surface abutting the outer flat face of the solid end cap 11. Concrete is then poured between the forms 26 and 19 and allowed to set. After the concrete has set in the desired structural form, the securing nut 23 may be unscrewed and the cross-member 21 removed. Both form walls 19 and 26 may then be removed and the remaining rod 16 and two end caps 11 and 17 removed from the sleeve 15 which remains embedded in the concrete structure to provide a smooth lined passageway therethrough for pipes or other utility conduits. The solid end cap 11 is retained by member 52 to prevent the cap's falling after the rod is unscrewed. The sleeve insert, including the two end caps 11 and 17, the rod 16, the retaining member 52 and hook 54, the cross-member 21 and securing nut 23 and washer 22, may all be reused in other sleeves for other passageways.

Figure 3:
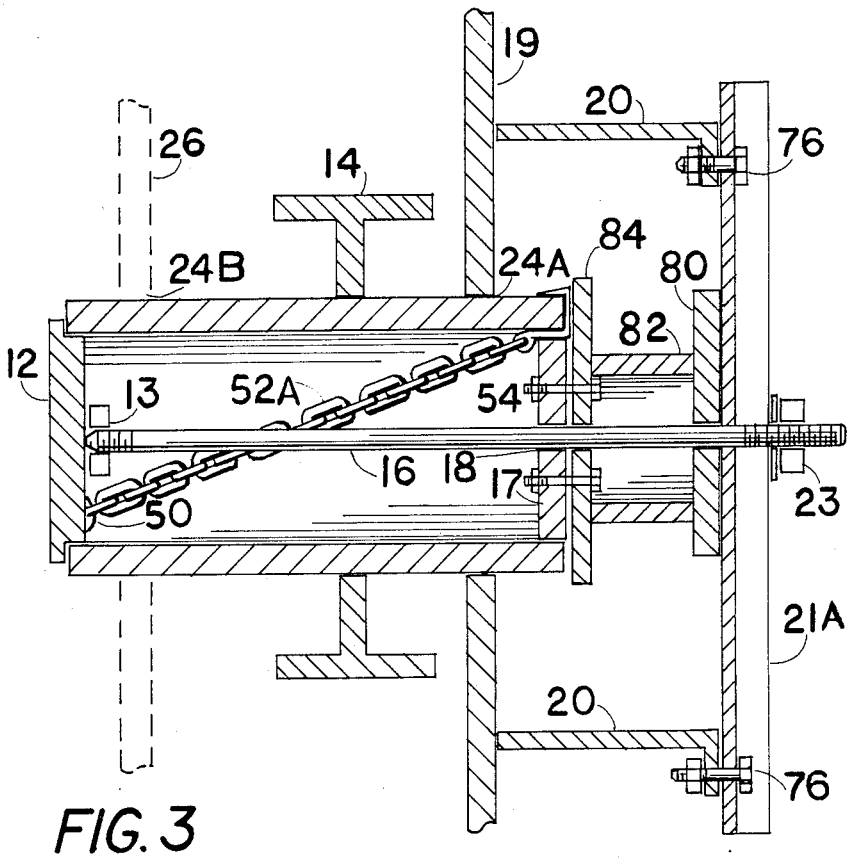
FIG. 3 is the sectional view of an alternate embodiment of the invention taken through the centerline of the sleeve as installed with the sleeve through both form walls.

In FIG. 3 an alternate embodiment of the invention provides a pipe sleeve 15 which extends beyond the faces of the concrete structure being formed. In this case, the holes 24A and 24B in the form walls are sufficiently large in diameter to accommodate and hold securely the entire sleeve 15. To accommodate the structural difference in the attachment to the form wall, the cross-member 21A is removably secured by bolts 76 to each of two adjacent ribs 20 on the outside of the form wall. For pipe sleeve extensions beyond the ribs, rib extensions bolted to the existing ribs will locate the cross-member a sufficient distance away from the wall to accommodate the pipe sleeve extension. For precise location of the end of the pipe sleeve, a spacer 82 of desired thickness is positioned between the cross-member 21A and the end of the pipe sleeve. The spacer 82 may be just a segment of hollow iron pipe sandwiched between two steel plates 80 and 84, wherein each plate is provided with a central opening just large enough to admit the threaded rod 16 therethrough for precise alignment. Attached by bolts to the steel plate 84 which contacts the end of the pipe sleeve, a circular end cap 17 fits snugly within the end of the pipe sleeve for precise sleeve alignment. The end cap 17 and plate 84 are provided with central openings just large enough to admit the threaded rod therethrough and may be fabricated of wood, plastic, metal such as steel and high strength aluminum or reinforced fiberglass. An alternate retaining member 52A is shown as a link chain secured between a disc loop 50 and sleeve end hook 54.

Each of the two ends of the pipe sleeve may protrude beyond each of the two form walls 19 and 26. The length and placement of the pipe sleeve will determine the extent of the protrusion on each side. Each wall must be provided with an opening 24A and 24B just large enough to admit the entire pipe sleeve therethrough. After the end cap 11, disc 17 and plate 84, the retaining member 52A and the rod 16 are in place within the sleeve 15, the entire sleeve end is inserted through the large opening 24A in the first form wall 19 which is erected in place. The spacer 82 and second plate 80 are slid into place and the cross-member 21A provided with an opening sufficiently large to admit the threaded rod is slid onto the rod and bolted to the ribs 20. The nut 23 is then tightened onto the rod 16 drawing the pipe sleeve in securely and aligning the sleeve properly relative to the form wall. The second form wall 26 may be just slid into place over the opposite sleeve end if it is protruding, or placed against the sleeve end for a non-protruding sleeve as in FIG. 2. As in the previous embodiment, after the concrete hardens the rod, end caps, cross-member, spacers, plates and retaining member are all removed to be reused, leaving the pipe sleeve in place in the cement wall to receive a pipe therethrough.

Figure 4:
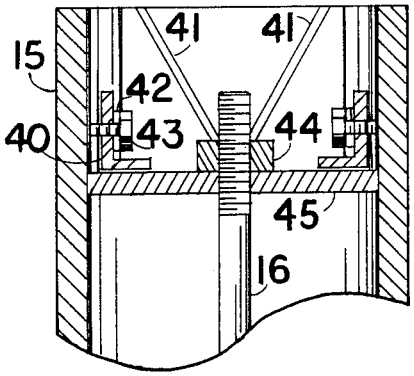
FIG. 4 is a partial sectional view taken through 4—4 of FIG. 5, showing an alternate embodiment of the invention with a recessed sleeve insert.
Figure 5:
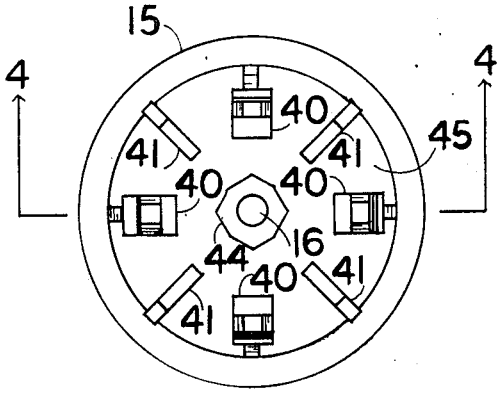
FIG. 5 is an end elevational view of the alternate embodiment of the invention showing the recessed sleeve insert.

In FIGS. 4 and 5 an alternate embodiment of the invention provides a recessed end plate 45 which is set down into the sleeve so that no part of the insert protrudes beyond the end of the sleeve. Wedges 41 formed of metallic plate are welded perpendicularly to the recessed end plate 45 in a spaced arrangement around the periphery of the plate touching the interior of the sleeve. The end of each wedge extends outwardly into a notch in the interior surface of the sleeve, to engage the insert in the sleeve. Intermittently spaced with the wedges are angles 40 welded to the outer surface of the end plate. Each angle is provided with a threaded hole or a hole and nut 42 welded to the angle so that a bolt 43 or other threaded fastener may be threaded through the angle against the inner surface of the sleeve to secure the end plate within the sleeve. The end plate 45 is provided with a central opening through which the rod 16 passes and the rod 16 is secured adjustably therein by a bolt 55 which may be welded to the plate 45. The recessed plate insert enables the end of the sleeve to be aligned evenly with the face of the concrete structure.

Figure 6:
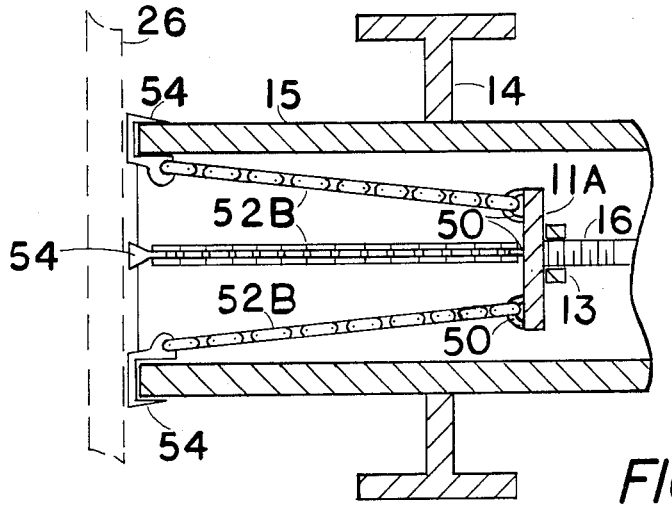
FIG. 6 is a partial cross-sectional view through the pipe sleeve showing an alternate disc secured to the end of the pipe sleeve by a series of retaining members such as link chains.
Figure 7:
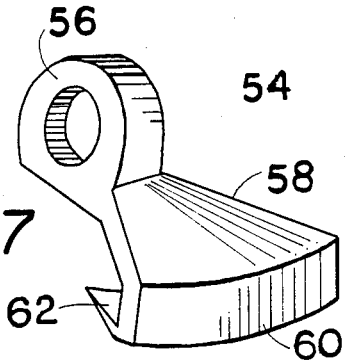
FIG. 7 is an enlarged perspective view of a hook used to secure the retaining members to the end of the pipe sleeve.
Figure 8:
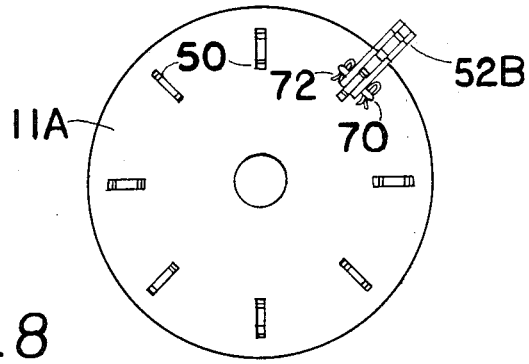
FIG. 8 is an exploded elevation view of an alternate embodiment of the internal disc showing a series of loop means of securing retaining members to the disc.

In FIG. 6 an adjustable pipe sleeve insert provides a solid disc 11A smaller in diameter that the pipe sleeve 15 and located within the interior of the sleeve. A series of retaining members 52B, indicated as roller chains in this embodiment, are evenly spaced around the perimeter of the disc and connected thereto by a series of loops 50 welded to the exterior face of the disc 11A or formed by extensions of the disc. Alternate retaining members may be link chains, wire cables or rods all of the same length in each case. Each retaining member is removably secured over the edge of the pipe sleeve by a series of hooks 54, shown enlarged in FIG. 7 each with a loop 56 to receive the retaining member an outwardly expanding portion 58 which may be arched to conform to the internal surface of the pipe sleeve. An arched hook-over portion 60 conforms to the edge of the pipe sleeve and overlapping retaining portion 62 holds the hook in place. In FIG. 8 an exploded view of the solid disc 11B shows a series of eight loops 50 spaced evenly around the perimeter of the disc to receive the retaining members secured to the loop by chain pins 70 secured by cotter pins 72 or any conventional means. When the rod 16 is tightened into the welded nut 13 on the disc 11A, the retaining members 52B draw in the edge of the pipe sleeve to secure the pipe sleeve to the form wall. Each internal disc 11A and series of retaining members 52B serves a wide variety of pipe sleeve sizes and therefore provides an adjustable pipe sleeve insert. For greatly varying pipe sleeve diameters different disc diameters and retaining member lengths may be used.

Although metal is a preferred material for the sleeve and insert, such as cast iron, steel, or high strength aluminum, other materials such as plastic or reinforced fiberglass could be used, if it were of structural quality to sustain the heavy weight of the concrete. The securing device with the protruding rod and cross-member could be applied to both forms if necessary for extra strength, although applying the attaching means to one form is preferred for each installation. Another use would provide a passage only part of the way through the structure by leaving a space between the solid plate 11 and the nonattached form 26. The device may be applied for passages through any forming material such as concrete and through any structural member such as walls, floors or ceilings. Although the preferred embodiment of the sleeve is cylindrical in shape for pipe passages, other shapes of sleeves may be used for other purposes, such as a box-like sleeve for rectangular air ducts.

It is understood that the preceding description is given merely by way of illustration and not in limitation and that various modifications may be made thereto without departing from the spirit of the invention as claimed.

I claim:

1. A pipe sleeve device for forming a passage through a concrete structure used in conjunction with a vertical form wall, which device is rigidly self-aligned and totally secured by attaching the device to a single vertical form wall and the device comprises:

a first form wall provided with an interior surface which contacts the concrete, an exterior surface having spaced wall ribs and a hole through the wall between two adjacent wall ribs connecting the two surfaces;

a rigid hollow pipe sleeve around which concrete may be poured and which thereby forms a passage in the concrete, which pipe sleeve is provided with an opening at each end and an internal sleeve diameter which serves as the boundaries of a clear passage through the hollow pipe sleeve, and which pipe sleeve is located interiorly of the form wall;

a first solid disc bordering a first pipe sleeve opening and removably secured thereto and which first solid disc has a perimeter;

a safety retaining means retaining the first solid disc to the sleeve to prevent the first solid disc from falling;

a second end disc covering a second sleeve opening, which second end disc is provided with a small central opening therethrough and which second end disc fits tightly and removably within the second sleeve opening, wherein the second end disc opening is aligned with the wall hole to assure alignment of the device;

a removable rigid rod elongated member centrally located within the sleeve, secured to the interior of the first solid disc and extending out through the opening in the second end disc, wherein the extended end of the rod passes through the opening in the form wall;

a rigid cross-member secured to the end of the rod exteriorly of the form wall spanning a substantial portion of the wall;

a rod fastener means to create a compressive force between the cross-member and the sleeve to pull the first solid disc toward the second end disc and the sleeve against the first form wall to sandwich the wall securely therebetween, so that the device is sufficiently secured to the first form wall to resist the weight of the concrete;

a second vertical form wall which merely abuts the first sleeve and which second form wall is secured to the first form wall by means independent of the device for receiving poured concrete between the form walls.

2. The invention of claim 1 wherein the first solid disc is positioned interiorly of the first end of the pipe sleeve and the retaining means which also functions as an aligning means to align the pipe sleeve with the first form wall comprises a series of equal length elongated members each secured, at one end, to an exterior face of the first solid disc and, at an opposite end, hooked over an edge of and evenly spaced around the perimeter of the first sleeve opening, wherein the series of elongated members thereby also removably secure the first solid disc to the first sleeve opening.

3. The invention of claim 2 wherein the first solid disc comprises rigid plate smaller in diameter than the internal pipe sleeve diameter and the first solid disc is provided with a series of loops protruding, at evenly spaced intervals, from the exterior face of the first solid disc adjacent to the outer perimeter of the first solid disc.

4. The invention of claim 2 wherein each retaining elongated member comprises a roller chain.

5. The invention of claim 2 wherein each retaining elongated member comprises a link chain.

6. The invention of claim 2 wherein each retaining elongated member comprises a wire rope.

7. The invention of claim 2 wherein each retaining elongated member comprises a steel rod.

8. A pipe sleeve device for forming a passage through a concrete structure used in conjunction with a vertical form wall, which device is rigidly self-aligned and totally secured by attaching the device to a single vertical form wall with a pipe sleeve end protruding through the form wall to which the sleeve is attached, and the device comprises:

a first form wall provided with an interior surface which contacts the concrete, an exterior surface having spaced wall ribs and an interconnecting hole between two adjacent ribs through the wall just large enough to admit a cross-section of the pipe sleeve which protrudes through the first form wall;

a rigid hollow sleeve around which concrete may be poured and which thereby forms a passage in the concrete, which sleeve is provided with an opening at each end forming a clear passage through the hollow sleeve, and which sleeve protrudes through the interconnecting hole in the first form wall;

a first solid disc bordering one sleeve opening located interiorly of the first form wall, which first solid disc is removably secured to the interiorly located sleeve opening;

a safety retaining means retaining the first solid disc to the sleeve to prevent the first solid disc from falling;

an exterior elongated member secured to the protruding end sleeve, which exterior elongated member extends beyond the periphery of the sleeve in at least two directions over a portion of the wall and which exterior elongated member is provided with a small opening centrally located over the sleeve opening and which exterior elongated member is removably secured to each of two wall ribs adjacent to the wall opening;

a spacer means removably secured between the exterior elongated member and the pipe sleeve and;

a removable rigid rod elongated member centrally located within the sleeve, secured to the interior of the first solid disc and extending out through the small opening in the exterior elongated member to which the rod is secured;

A rod fastener means to create a compressive force between the angular member and the sleeve by pulling the first solid disc against the sleeve and the sleeve against the exterior elongated member, so that the device is sufficiently secured to the first form wall to resist the weight of the concrete;

a second vertical form wall which merely abuts the interiorly located sleeve opening and which second form wall is secured to the first form wall by a means independent of the device for receiving poured concrete between the form wall.

9. The invention of claim 8 wherein the retaining means comprises at least one elongated element secured, at one end, to the interior of the first solid disc and, at an opposite end hooked over an edge of the protruding end of the sleeve and the first solid disc is removably secured to the interiorly located sleeve opening by overlapping the interiorly located sleeve opening.

10. The invention of claim 8 wherein the first solid disc is positioned interiorly of the end of the sleeve and the retaining means which also functions as an aligning means to align the pipe sleeve with the first form wall comprises a series of equal lengths elongated members each secured, at one end, to the exterior of the first solid disc to each of a series of loops protruding from the disc, and, at an opposite end, hooked over an edge of, and evenly spaced around, the perimeter of the interiorly located sleeve opening, wherein the series of elongated members thereby also removably secure the first solid disc to the interiorly located sleeve opening.

11. The invention of claim 8 wherein the second vertical form wall is further provided with an opening therethrough just large enough to admit the pipe sleeve and the normally interior sleeve opening end protrudes through the opening in the second vertical form wall.

12. A pipe sleeve device for forming a passage through a concrete structure used in conjunction with a vertical form wall, which device is rigidly self-aligned and totally secured by attaching the device to a single vertical form wall and the device comprises:

a first form wall provided with an interior surface which contacts the concrete, an exterior surface having spaced wall ribs and a hole through the wall between two adjacent wall ribs connecting the two surfaces;

a rigid hollow sleeve around which concrete may be poured and which thereby forms a passage in the concrete, which sleeve is provided with an opening at each end and an internal pipe sleeve diameter which serves as the boundaries of a clear passage through the hollow sleeve, and which sleeve is located interiorly of the form wall;

a first solid disc bordering a first sleeve opening and removably secured thereto and which first solid disc has a perimeter;

a retaining means comprising at least one elongated element secured, at one end, to an interior face of the first solid disc and, at an opposite end, hooked over an edge of the second sleeve opening and the first solid disc is removably secured to the first sleeve opening by overlapping the first sleeve opening;

a second end disc covering a second sleeve opening, which second end disc is provided with a small central opening therethrough and which second end disc fits tightly and removably within the second sleeve opening, wherein the second end disc opening is aligned with the wall hole to assure alignment of the device;

a removable rigid rod elongated member centrally located within the sleeve, secured to the interior of the first solid disc and extending out through the opening in the second end disc, wherein the extended end of the rod passes through the opening in the form wall;

a rigid cross-member secured to the end of the rod exteriorly of the form wall spanning a substantial portion of the wall;

a rod fastener means to create a compressive force between the cross-member and the sleeve to pull the first solid disc toward the second end disc and the sleeve against the first form wall to sandwich the wall securely therebetween, so that the device is sufficiently secured to the first form wall to resist the weight of the concrete; a second vertical form wall which merely abuts the first sleeve end and which second form wall is secured to the first form wall by means independent of the device for receiving poured concrete between the form walls.

13. The invention of claim 12 wherein the rod elongated member is provided with a threaded inner end and the first solid disc is provided on an interior face only with a threaded opening to receive th elongated member and removably secure the member to the sleeve, thereby leaving a smooth exterior face of the first solid disc for a flush abutment against the second form wall.

14. The invention of claim 13 wherein the threaded opening is a nut welded to the interior face of the first solid disc.

15. The invention of claim 12 wherein the rigid cross-member spans at least two ribs.

16. The invention of claim 12 wherein the first solid disc is larger than the end opening of the sleeve by a thin steel lip around the perimeter of the solid disc which lip covers a portion of the sleeve end and which first solid disc is held removably against the outside of the sleeve by the force of the elongated member.

17. The invention of claim 12 wherein the first solid disc is slightly smaller than the sleeve opening and the first solid disc is recessed within the sleeve and removably secured therein by means of at least three metal angles secured to the first solid disc, each of which metal angles is provided with a threaded opening through which a threaded fastener is screwed tightly against the interior of the sleeve.

18. The invention of claim 12 wherein each retaining elongated element comprises roller chain.

19. The invention of claim 12 wherein each retaining elongated element comprises link chain.

20. The invention of claim 12 wherein each retaining elongated element comprises wire rope.

* * * * *